US010676317B2

(12) United States Patent
Müller et al.

(10) Patent No.: US 10,676,317 B2
(45) Date of Patent: Jun. 9, 2020

(54) METHOD FOR OPERATING A LIFT SYSTEM

(71) Applicants: ThyssenKrupp Elevator AG, Essen (DE); ThyssenKrupp AG, Essen (DE)

(72) Inventors: Jörg Müller, Deizisau (DE); Stefan Gerstenmeyer, Filderstadt (DE)

(73) Assignees: THYSSENKRUPP ELEVATOR AG, Essen (DE); THYSSENKRUPP AG, Essen (DE)

( * ) Notice: Subject to any disclaimer, the term of this patent is extended or adjusted under 35 U.S.C. 154(b) by 371 days.

(21) Appl. No.: 15/517,996

(22) PCT Filed: Oct. 9, 2015

(86) PCT No.: PCT/EP2015/073436
§ 371 (c)(1),
(2) Date: Apr. 10, 2017

(87) PCT Pub. No.: WO2016/055630
PCT Pub. Date: Apr. 14, 2016

(65) Prior Publication Data

US 2017/0297858 A1 Oct. 19, 2017

(30) Foreign Application Priority Data

Oct. 10, 2014 (DE) ..... 10 2014 220 629

(51) Int. Cl.
*B66B 1/24* (2006.01)
*B66B 5/00* (2006.01)
*B66B 1/30* (2006.01)

(52) U.S. Cl.
CPC ..... *B66B 1/2433* (2013.01); *B66B 1/302* (2013.01); *B66B 5/0031* (2013.01); *B66B 2201/30* (2013.01)

(58) Field of Classification Search
CPC combination set(s) only.
See application file for complete search history.

(56) References Cited

U.S. PATENT DOCUMENTS 6,273,217 B1 * 8/2001 Hikita ..... B66B 1/18 187/382
6,619,437 B2 * 9/2003 Hikita ..... B66B 1/18 187/383

(Continued)

FOREIGN PATENT DOCUMENTS

CN 1668521 A 9/2005
CN 101568482 A 10/2009

(Continued)

OTHER PUBLICATIONS

English translation of International Search Report issued in PCT/EP2015/073436, dated Dec. 3, 2015 (dated Dec. 11, 2015).

(Continued)

*Primary Examiner* — Christopher Uhlir
(74) *Attorney, Agent, or Firm* — thyssenkrupp North America, LLC

(57) ABSTRACT

A method for operating an elevator system, which may include at least two cars that can move independently of one another within a common elevator shaft, may involve determining with an elevator controller to cause a first car of the at least two cars to perform a transportation process from a start stopping point to a destination stopping point. The elevator controller may determine a starting time and travel parameters according to which the first car carries out the transportation process from the start stopping point to the destination stopping point. The starting time and the travel parameters may be determined by taking into account state parameters of a second car of the at least two cars.

12 Claims, 2 Drawing Sheets

(56) References Cited

U.S. PATENT DOCUMENTS

| | | | | |
|---|---|---|---|---|
| 7,540,356 | B2 | 6/2009 | Smith et al. | |
| 7,819,228 | B2 | 10/2010 | Terry et al. | |
| 8,424,651 | B2 * | 4/2013 | Brand | B66B 5/0031 187/249 |
| 9,592,994 | B2 * | 3/2017 | Finschi | B66B 1/2458 |
| 2004/0256179 | A1 | 12/2004 | Deplazes | |
| 2008/0306961 | A1 * | 12/2008 | Pineau | B66B 1/34 |
| 2010/0065378 | A1 | 3/2010 | Christy | |
| 2011/0272220 | A1 | 11/2011 | Kostka | |
| 2012/0118672 | A1 | 5/2012 | Brand | |

FOREIGN PATENT DOCUMENTS

| | | | |
|---|---|---|---|
| CN | 101878174 | A | 11/2010 |
| CN | 103429516 | A | 12/2013 |
| EP | 1489033 | A | 12/2004 |
| EP | 1565396 | B | 1/2007 |
| EP | 2238064 | A | 10/2010 |
| EP | 2370334 | B | 10/2011 |
| EP | 2695838 | A | 2/2014 |

OTHER PUBLICATIONS

Enhancements to the ETD Dispatcher Algorithm (Rory Smith, Richard Peters; ELEVCON 2004); https://www.peters-research.com/index.php/support/articles-and-papers/43-enhancements-to-the-etd-dispatcher-algorithm.

* cited by examiner

METHOD FOR OPERATING A LIFT SYSTEM

CROSS REFERENCE TO RELATED APPLICATIONS

This application is a U.S. National Stage Entry of International Patent Application Serial Number PCT/EP2015/073436, filed Oct. 9, 2015, which claims priority to German Patent Application No. DE 10 2014 220 629.4 filed Oct. 10, 2014, the entire contents of both of which are incorporated herein by reference.

FIELD

The present disclosure generally relates to elevator systems and methods for operating elevator systems that have at least two cars that can move independently in one or more elevator shafts.

BACKGROUND

In a multi-car system of an elevator system, a plurality of cars can move independently of one another in a common elevator shaft or a plurality of elevator shafts. In such multi-car systems, expedient safety measures are usually carried out to avoid the occurrence of a collision between cars.

For example, such safety measures relate to the case in which a first car is to carry out a transportation process from a start stopping point to a destination stopping point. In order to avoid a collision of this first car with a further car of the elevator system and to ensure a safe transportation process of the first car, this transportation process can be carried out, for example, only when there is no other car of the elevator system located in this region between the start stopping point and the destination stopping point. In this context, reference is made, for example, to EP 1 565 396 B1.

If appropriate, the system waits, i.e. the first car remains at the start stopping point, until all the other cars are moved out of this region in the course of corresponding transportation processes or even have been completely moved out of this region. This can lead, under certain circumstances, to long waiting times for passengers of the first car at the start stopping point before the first car begins the transportation process.

Such long waiting times are usually felt to be very unpleasant for passengers. Furthermore, such long waiting times can also annoy and upset the waiting passengers. In general, such waiting times worsen the travel comfort and adversely affect the sense of wellbeing of the passengers.

It is therefore desirable to reduce such waiting times in an elevator system with a plurality of cars in an elevator shaft.

DETAILED DESCRIPTION

Figure 1:
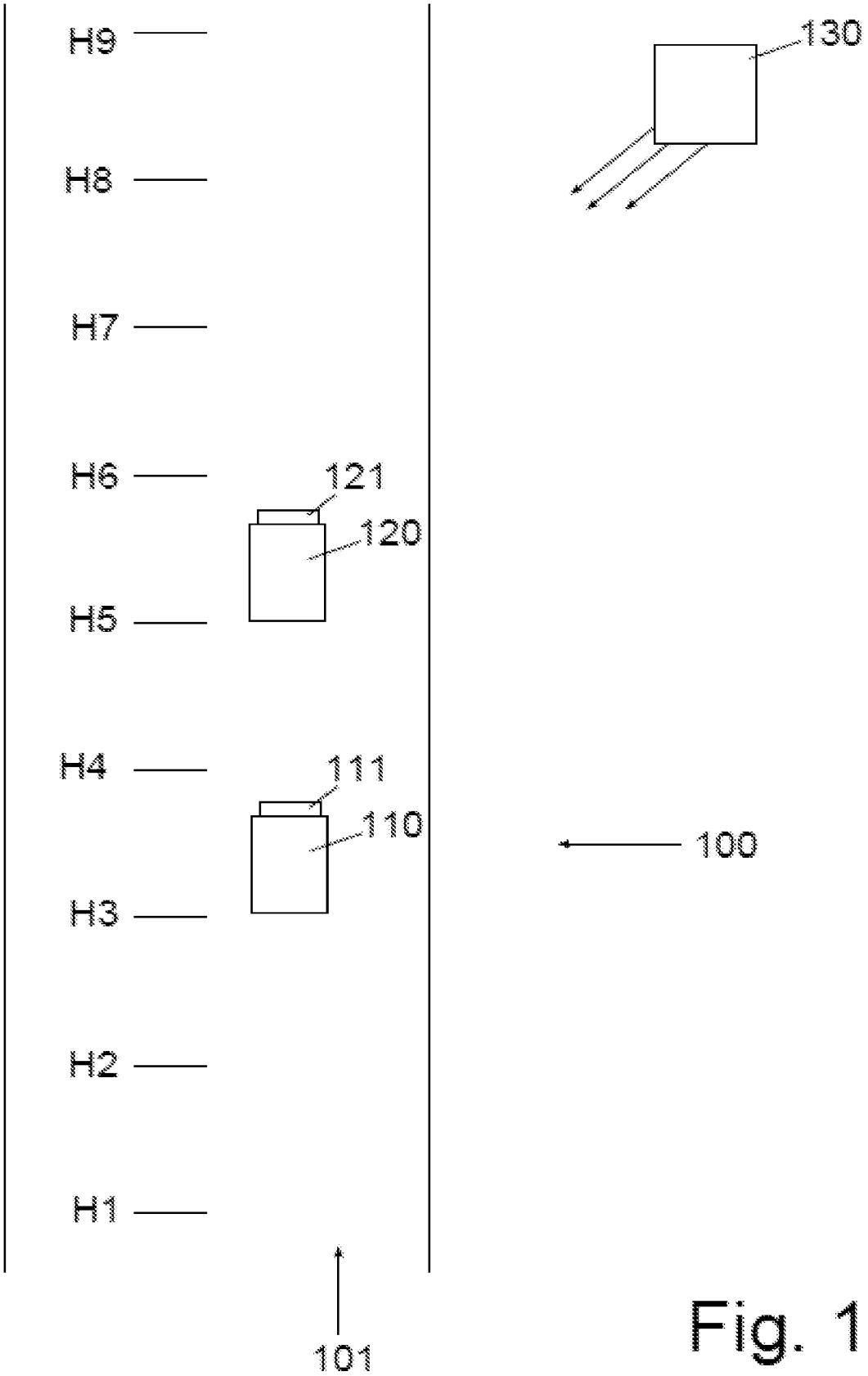
FIG. 1 is a schematic view of an example elevator system, which can be operated according to an example method of the present disclosure.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The invention proposes a method for operating an elevator system having at least two cars which can move independently of one another in at least one common elevator shaft, wherein a first car of the at least two cars is determined by an elevator controller to carry out a transportation process from a start stopping point to a destination stopping point, wherein a starting time of the first car at which the first car begins the transportation process from the start stopping point, and travel parameters according to which the first car carries out the transportation process from the start stopping point to the destination stopping point, are determined by the elevator controller. The starting time and the travel parameters are determined taking into account state parameters of at least one second car of the at least two cars.

The invention also proposes a corresponding elevator system having at least two cars which can move independently of one another in at least one common elevator shaft, and having an elevator controller which is capable of carrying out such a method.

In the elevator system according to the invention, at least two cars move in a common elevator shaft or in a plurality of common elevator shafts, in particular independently of one another. In each of the elevator shafts, in particular in each case at least two cars can move independently of one another. The invention is also suitable for shaft-changing multi-car systems in which cars can change between different elevator shafts. Therefore, such a configuration is also provided as a further aspect of the invention.

A first car of these at least two cars is determined by an elevator controller to carry out a transportation process from a start stopping point to a destination stopping point, in particular in a specific elevator shaft.

According to the invention, the elevator controller determines a starting time at which the first car begins this transportation process from the start stopping point, and travel parameters according to which the first car is to carry out this transportation process from the start stopping point to the destination stopping point. This determination is carried out taking into account state parameters of at least one second car of the at least two cars. In particular, this at least one second car is also arranged in the same specific elevator shaft.

According to the invention, before the first car begins the transportation process, the starting time and travel parameters are determined in such a way that the first car can begin the transportation process from the start stopping point, in particular as quickly as possible, and can also, in particular, carry it out as quickly as possible.

In particular, for this determination, state parameters are taken into account of those cars which are located in the region between the start stopping point and the destination stopping point in the specific elevator shaft at the time of the determination. These state parameters describe, in particular, where the corresponding car is currently located in the specific elevator shaft and/or where the corresponding car is currently moving, or to where it will shortly be moved, in the specific elevator shaft.

In particular, the elevator controller determines in each case a travel curve of the respective car, in particular a speed travel curve, from the state parameters. Such a travel curve is, in particular, a function of the position of the respective car in the elevator shaft plotted over the time or a function of the speed of the respective car in the elevator shaft plotted over the time or over the position of the car. The position of the respective car can, in particular, be extrapolated by means of such a travel curve. By taking into account this travel curve, the elevator controller determines, in particular, a travel curve for the first car, according to which travel curve the first car carries out the transportation process.

Accordingly, the elevator controller determines, on the basis of the state parameters, the travel parameters of the first car and, in turn, in particular, the starting time and the travel curve of the first car from said travel parameters.

The method according to the invention is provided, in particular, for use for a two-car system in which two cars can move independently of one another in the common elevator shaft. Such two-car systems are marketed by the applicant under the designation "TWIN". The invention is not limited to two-car systems and is also suitable, in particular, for multi-car systems with an expedient number of cars.

For the sake of simplicity, the following description will be directed to "a second car" or "the second car". Without limiting the generality, the following statements apply analogously for "a plurality of second cars" or a plurality of cars.

The elevator controller can advantageously be embodied here as a central control unit. The elevator controller can be linked or networked, in particular, to individual car controllers of the individual cars. These individual car controllers can transfer data (e.g. position data and speed data of the respective car) to the elevator controller, which data is taken into account in the determination of the starting time and/or travel parameters.

Advantages Of The Invention

In particular, the travel parameters for carrying out the transportation process are determined in such a way that the earliest possible starting time can be determined, i.e. the first car begins the transportation process as far as possible without waiting times for the user. The invention makes it possible for the smallest possible time interval to occur between an entry time at which a passenger enters the first car at the start stopping point and the starting time.

It is therefore possible to ensure the shortest possible waiting time between the entry time and the starting time for a passenger. Unpleasant, annoying, upsetting or long waiting times are avoided by the invention. Travel comfort and the sense of wellbeing of the passengers are improved.

As a result of the invention it is not necessary for the first car to wait for the transportation process to begin and for the car to remain in the start stopping point until the second car is moved or has moved out of the region between the start stopping point and the destination stopping point.

By taking into account the state parameters of the second car it is advantageously made possible for the first car to be able to begin the transportation process while the second car is still in the region between the start stopping point and the destination stopping point. Since the state parameters advantageously provide information as to where the second car is in the elevator shaft and where the second car is moving to, the first car can safely carry out the transportation process without a collision occurring between the first and second cars.

As a result of the invention, the first car can carry out the transportation process with travel parameters which are optimized compared to conventional transportation processes. Transportation processes of the individual cars of the elevator system are matched to one another in an optimum way by the method according to the invention. The energy demand of the elevator system is optimized by the method according to the invention and decreased compared to known elevator systems. Furthermore, wear of mechanical components of the elevator system is advantageously reduced, for example because unnecessarily strong acceleration or braking of individual cars can be avoided.

The starting time and the travel parameters of the first car are preferably determined taking into account the state parameters of the at least one second car if the at least one second car is located in a region between the start stopping point and the destination stopping point. In particular, the at least one second car is located between the start stopping point and the destination stopping point at least when a destination call is registered. The first car advantageously starts the transportation process by means of the method according to the invention by taking into account state parameters of the at least one second car even if the at least one second car has not yet left the region between the start stopping point and the destination stopping point.

The starting time and the travel parameters are advantageously determined in such a way that a minimum distance or a speed-dependent safety distance between the first car and the at least one second car is not undershot. Safety regulations are therefore complied with and two cars are prevented from coming too near to one another.

Acceleration, braking, a speed, a maximum speed and/or a jolt (as a result of the acceleration and/or the braking) of the first car are preferably determined as travel parameters. These different travel parameters result in flexible combination possibilities for carrying out the transportation process. The jolt describes a change in the acceleration or the braking. Furthermore, a result of the jolt, that is to say a change in the jolt, can also be determined as travel parameters.

If the second car is still in the region between the start stopping point and the destination stopping point and is in the process of leaving said region, the transportation process can be carried out, for example, only with 50% of the maximum speed or only with 50% of the acceleration of normal travel.

In other cases, if, for example, it takes too long for the second car to leave the region, the transportation process can be carried out, for example, only with 25% of the acceleration of normal travel and/or with 40% of the maximum speed of normal travel. Normal travel is to be understood here as meaning how the transportation process is carried out when there are no cars in the region between the start stopping point and the destination stopping point.

The invention is based here on the realization that slow travel of the elevator car is accepted better by a user and is felt to be more pleasant than a relatively long waiting time between the entry time and the starting time, and subsequently relatively fast travel of the elevator car even if the arrival time were to be the same in both cases.

The travel parameters are therefore determined, in particular, in such a way that the waiting time between the entry time and the starting time is as short as possible. Long waiting times at a stopping point with the doors opened are felt by passengers to be generally more unpleasant than the time during the transportation process. Travel at half the speed compared to the normal travel (in particular in the case of short distances over a comparatively small number of stories) can in particular be felt to be less unpleasant than a waiting time which is twice as long at the start stopping point before the transportation process is begun.

The travel parameters of the first car, in particular the current travel parameters of the transportation process of the first car, are preferably indicated within the first car, for example by means of visual and/or acoustic display/indicator means. The travel parameters, in particular the current travel parameters, of the first car can be indicated as absolute values or as percentages compared to corresponding travel parameters of corresponding normal travel. Furthermore, a waiting time up to the starting time and/or an arrival time of the first car can be indicated within the first car.

A current position and/or a direction of travel of the (at least one) second car, in particular in the specific elevator shaft, are preferably taken into account as state parameters. These are sensed, in particular, by means of expedient position sensors in the elevator shafts and/or made available by the corresponding car controller. Furthermore, a future position of the second car can also be taken into account as a state parameter. This future position is, in particular, extrapolated or calculated in advance. Alternatively or additionally, a travel time, travel parameters of the at least one second car and/or a transportation process, to be carried out by the (at least one) second car, are preferably taken into account as state parameters. These travel parameters are, in particular, acceleration, braking, jolt, speed and/or maximum speed of the second car. The travel time is here, in particular, an extrapolated travel time which the second car takes to carry out the corresponding transportation process.

These state parameters can advantageously provide information, through corresponding evaluation on the part of the elevator controller, as to when the second car is in the region between the start stopping point and the destination stopping point, when it leaves this region and how long the second car takes to leave this region. The travel parameters of the transportation process of the first car can therefore be determined in an optimized way so that the first car can begin the transportation process as early as possible and carry it out safely, in particular without a collision occurring with the second car and without the safety distance being undershot. The safety distance can vary here, in particular, as a function of the speed of the cars, preferably in such a way that the safety distance is larger in the case of higher speeds than in the case of low speeds.

Stopping times at which the second car stops at stopping points are advantageously taken into account as state parameters. In particular, in this context stopping times are taken into account at stopping points which lie between the start stopping point and the destination stopping point of the transportation process to be carried out by the first car. Owing to the extrapolated travel times, it is known when the second car arrives at these stopping points.

In contrast to travel times, such stopping times are as a rule not capable of being determined deterministically. Travel times can be determined deterministically, in particular, as a function of the current travel parameters. During the stopping times, passengers can leave the second car or enter it. However, the behavior of passengers cannot be determined deterministically.

Therefore, the stopping times are preferably determined by stochastic evaluation. For example, the stopping times can be determined by empirical values, for example as a mean value of all the stopping times. Furthermore, travel profiles or utilization profiles can be used for the stochastic evaluation. Furthermore, on the basis of calls it is possible to derive how many passengers leave or enter the second car. For this purpose, information of a destination call controller can preferably be evaluated.

In order to be able to comply with these predetermined stopping times, according to the invention there is provision to carry out corresponding measures in the second car. For example, after the expiry of the predetermined stopping times a command can be output in order to close the doors of the second car. The second car is therefore advantageously prevented from arriving "with a delay" and/or the first and the second car are prevented from coming too close to one another and/or the safety distance is prevented from being undershot.

If the stopping times cannot be complied with as predetermined, for example because a passenger enters the second car while the doors are already closing and the doors have to be opened once more, corresponding measures are advantageously provided in order to avoid a collision of the first and second cars.

For this purpose, the travel parameters of the first car can advantageously be changed while the first car is carrying out the transportation process. The elevator controller evaluates or determines, by taking into account the state parameters of the second car, whether travel parameters of the first car are to be changed while the first car is carrying out the transportation process. The travel parameters are, in particular, correspondingly adapted here in order to prevent a collision between the first and second cars. If appropriate, a forced stop of the first car may also be necessary. Such a forced stop is carried out, in particular, at a stopping point. In this context, in particular the doors of the first car are opened in order to avoid upsetting the passengers and in order to avoid a constricted unpleasant sensation. If the forced stop occurs between two stopping points, the passengers can be informed by visual and/or acoustic display/indicator means.

The travel parameters can also be, in particular, adapted in such a way as to be able to carry out the transportation process more quickly. This may be the case, for example, if stopping times of the second car have been predetermined with excessively large values if the actual stopping time is therefore shorter than the predetermined stopping time.

In one preferred refinement, it is taken into account as a state parameter whether the second car leaves the region between the start stopping point and the destination stopping point in the course of a transportation process to be carried out by the second car within a determined time interval. If this is not the case, the second car blocks the region unnecessarily and the first car cannot begin its transportation process.

In this case, the elevator controller preferably moves the second car into an avoidance stopping point outside the region between the start stopping point and the destination stopping point. The elevator controller outputs, in particular, an expedient command to the second car. The avoidance stopping point is selected with respect to the destination stopping point of the first car, in particular, in such a way that the safety distance between the first and second cars is not undershot if the first car is at the destination stopping point.

The travel parameters of the first car are preferably determined taking into account an energy management system of the elevator system. In particular, the first car can be synchronized with a further car, in particular one which moves in the opposite direction. The travel parameters of the first car and of this further car can be determined as a function of one another. In the course of such synchronization, cars which are moving in the opposite direction can, in particular, be adjusted to one another in such a way that the cars which are moving in the opposite direction are set in motion essentially at the same time. As a result of the downward movement of the one car, it is possible to acquire energy which is used (instantaneously) for the upward movement of the other car. It is therefore possible, in particular, to optimize a subsequent value of the elevator system. An energy balance of the elevator system can therefore be optimized. The energy demand and the energy supply can be balanced out in an optimum way and an optimum energy balance can be achieved.

Furthermore, the travel parameters of the first car can preferably be determined taking into account energy consumption and/or wear of components of the elevator system. The energy consumption of the elevator system can be optimized and/or the wear of individual components can be reduced. For example, the acceleration and/or the braking of the first car can be decreased instead of reducing the speed or the maximum speed. It is therefore possible to avoid unnecessarily strong acceleration or braking and the wear of individual components can be decreased.

In particular, the elevator controller evaluates or determines, while taking into account the energy management system, whether travel parameters of the first car are changed while the first car carries out the transportation process. This may be the case, in particular, if the energy supply of the elevator system fails or there is a power outage. Such a change in the travel parameters of the first car in the course of a power outage while the first car is executing the transportation process can be carried out by the elevator controller, in particular according to the criteria described in U.S. Pat. No. 7,540,356 B2. A possible way of overcoming a power outage of an elevator system is disclosed in U.S. Pat. No. 7,540,356 B2. In the case of a power outage, travel parameters, in particular the speed, of cars are changed as a function of energy present in the elevator system and of energy which is necessary for overcoming the power outage.

Of course, the features which are mentioned above and those which are still to be explained below can be used not only in the respective specified combination but also in other combinations or alone without departing from the scope of the present invention.

FIG. 1 is a schematic illustration of a preferred refinement of an elevator system according to the invention, said elevator system being denoted by 100. Two cars 110 and 120 can move independently of one another in a common elevator shaft 101 in the elevator system 100. The elevator system 100 extends in this specific example over nine stories which are denoted by the reference symbols H1 to H9.

Each of the cars 110 and 120 has an individual car controller 111 or 121. The elevator system 100 also has an elevator controller 130. The elevator controller 130 and the car controllers 111 and 121 are connected to one another, in particular via a suitable communication bus, for example a field bus.

The elevator controller 130 is also configured to carry out a preferred embodiment of a method according to the invention. For this purpose, in particular a preferred refinement of a computer program according to the invention is executed in the elevator controller 130.

For example, a passenger wishes to be transported from the third storey H3 to the seventh storey H7. For this purpose, the passenger activates a corresponding destination selection controller at this start stopping point H3. The passenger in this way informs the elevator controller 130 of the destination storey H7. The elevator controller 130 determines car 110 as the first car, in order to carry out this transportation process. The elevator controller 130 outputs a command to the car controller 111 of the first car 110. The car controller 111 correspondingly actuates the first car 110, and the first car 110 is moved to the start stopping point H3. At an entry time, the passenger enters the first car 110 at the start stopping point H3.

The elevator controller 130 then determines a starting time and travel parameters for the transportation process from the start stopping point H3 to the destination stopping point H7. This determination is carried out taking into account state parameters of the second car 120.

The second car 120 is on the fifth storey H5 at the entry time. The second car 120 is to carry out a transportation process from the fifth storey H5 to the sixth storey H6, and subsequently a further transportation process from the sixth storey H6 to the ninth storey H9. These two transportation processes, corresponding travel parameters of the second car 120 and stopping times of the second car 120 at the fifth storey H5 and at the sixth storey H6 are taken into account as state parameters by the elevator controller 130 for the determination of the transportation process of the first car 110.

The elevator controller 130 determines an average stopping time of the second car 120 by means of a statistical evaluation of travel profiles. This statistically determined stopping time is used as a predetermined stopping time for the fifth and sixth stories H5 and H6.

The car controller 121 of the second car 120 transfers the acceleration, speed and braking as travel parameters to the elevator controller 130. The second car 120 carries out the two transportation processes according to these travel parameters.

The elevator controller 130 determines a travel curve of the second car 120 as a function of these travel parameters and of these stopping times of the second car 120. This travel curve corresponds to an extrapolation of the position of the second car 120 in the elevator shaft 101.

By taking into account this travel curve of the second car 120, the elevator controller 130 determines a travel curve of the first car 110. For this travel curve, the starting time and the travel parameters of the first car 110 are determined in such a way that the first car 110 can begin its transportation process as quickly as possible (that is to say that the smallest possible time interval is present between the entry time and the starting time) and that the first car 110 and the second car 120 do not undershoot a predefined minimum distance or a speed-dependent safety distance with respect to one another.

The elevator controller 130 determines the acceleration, speed and braking of the first car 110 as travel parameters. The elevator controller 130 transfers these travel parameters and the starting time to the car controller 111. The car controller 111 actuates the first car 110 correspondingly so that the transportation process from the start stopping point H3 to the destination stopping point H7 is carried out at the starting time with the corresponding travel parameters.

Figure 2:
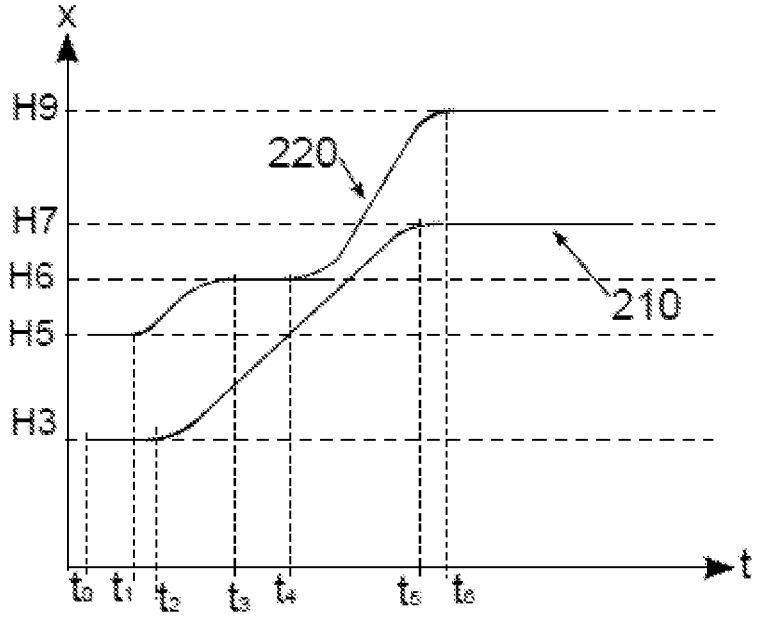
FIG. 2 is a schematic view of travel curves of cars of an example elevator system, which travel curves can be determined in the course of an example method of the present disclosure.

FIG. 2 illustrates schematically these travel curves, determined by the elevator controller 130, in a diagram of the car position x in the elevator shaft 101 plotted against the time t.

$t_0$ characterizes the entry time at which the passenger enters the first car 110 at the start stopping point H3. The travel curve for the second car 120 is characterized by 220 and is extrapolated by the elevator controller 130. The time $t_1$ at which the second car leaves the fifth storey is extrapolated by statistical evaluation. The times $t_3$ and $t_4$ characterize the statistically determined stopping time for the stopping of the second car 120 at the sixth storey H6. The elevator controller 130 also extrapolates so that the second car reaches the ninth storey H9 at the time $t_6$.

The elevator controller 130 determines the travel curve 210 of the first car 110 by taking into account this travel curve 220 of the second car 120. The starting time which is determined by the elevator controller and at which the first car 110 begins the transportation process is denoted by $t_2$. The extrapolated arrival time at which the first car 110 reaches the destination stopping point H7 is denoted by $t_5$.

Figure 3:
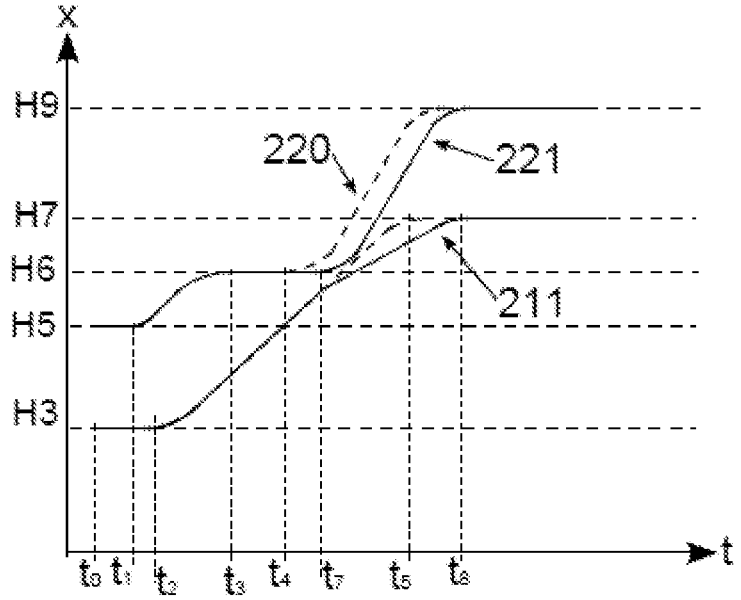
FIG. 3 is a schematic view of travel curves of an example system, which travel curves can be determine in the course of another example method of the present disclosure.

Further travel curves are illustrated in FIG. 3 in a way analogous to FIG. 2. FIG. 3 illustrates by way of example that the actual stopping time of the second car 120 at the sixth storey is longer than the stopping time extrapolated by the elevator controller.

The actual travel curve of the second car 120 is represented by 221. The extrapolated travel curve 220 according to FIG. 2 is represented by dashed lines in FIG. 3 in the area in which the extrapolated travel curve 220 differs from the actual travel curve 221.

For example, a passenger enters the second car 120 at the sixth storey while the doors are already closing. The doors therefore have to be opened once more and the stop is prolonged. The stop therefore does not end at the time $t_4$, as has been extrapolated by the elevator controller, but rather at the time $t_7$.

If the first car 110 were to continue the transportation process according to the extrapolated travel curve 210, the safety distance between the first car 110 and the second car 120 would be undershot owing to the long stop of the second car 120. So that this safety distance is not undershot, at the time $t_7$ the travel parameters of the first car 110 are adapted by the elevator controller 130. In this example, the speed of the first car 110 is reduced.

In FIG. 3, the actual travel curve of the first car 110 is denoted by 211. The extrapolated travel curve 210 according to FIG. 2 is represented by dashed lines in FIG. 3 in the area in which the extrapolated travel curve 210 differs from the actual travel curve 211.

As a result of the decrease in the speed of the first car 110, the arrival time of the first car 110 at the destination storey H7 is shifted from the time $t_5$ to the time $t_8$.

What is claimed is:

1. A method for operating an elevator system that includes a first car and a second car that move in an elevator shaft, the method comprising:

determining with an elevator controller that the first car is designated to perform a transportation process from a start stopping point to a destination stopping point;

determining with the elevator controller a starting time when the first car will start the transportation process;

determining travel parameters according to which the first car performs the transportation process based on state parameters of the second car in response to the second car being located in a region between the start stopping point and the destination stopping point while the first car performs the transportation process, wherein the state parameters include whether the second car leaves the region between the start stopping point and the destination stopping point in a course of the transportation process to be performed by the second car within a determined time interval;

starting operation of the first car at the determined starting time and operating the first car according to the determined travel parameters; and moving the second car into an avoidance stopping point outside the region between the start stopping point and the destination stopping point in response to the second car not leaving the region in the course of the transportation process to be performed by the second car within the determined time interval.

2. The method of claim 1 wherein the starting time and the travel parameters are determined taking into account the state parameters of the second car such that at least one of a minimum distance or a speed-dependent safety distance between the first car and the second car are not undershot.

3. The method of claim 1 wherein the travel parameters include at least one of an acceleration, a braking, a speed, a maximum speed, or a jolt of the first car.

4. The method of claim 1 wherein the state parameters include at least one of a current position of the second car, a direction of travel of the second car, a travel time of the second car, travel parameters of the second car, or a transportation process to be performed by the second car.

5. The method of claim 1 wherein the state parameters include stopping times at which the second car stops at stopping points.

6. The method of claim 5 wherein the stopping times are determined by at least one of stochastic evaluation or by evaluation of a destination call controller.

7. The method of claim 1 further comprising determining whether the travel parameters are to be changed while the first car performs the transportation process based on the state parameters of the second car.

8. The method of claim 1 comprising determining the travel parameters of the first car by taking into account at least one of an energy management system of the elevator system, energy consumption, or wear of components of the elevator system.

9. The method of claim 1 further comprising displaying inside the first car at least one of the travel parameters of the first car, a waiting time until the starting time of the first car, or an arrival time of the first car.

10. An elevator system comprising:

a first car disposed in a shaft;

a second car disposed in the shaft, the first and second cars being movable in the shaft; and an elevator controller that is configured to command the first car to perform a transportation process from a start stopping point to a destination stopping point, determine a starting time at which the first car begins the transportation process from the start stopping point and travel parameters according to which the first car performs the transportation process, wherein as part of determining the starting time and the travel parameters the elevator controller takes into account state parameters of the second car in response to the second car being located in a region between the start stopping point and the destination stopping point while the first car performs the transportation process, wherein the state parameters include whether the second car leaves the region between the start stopping point and the destination stopping point in a course of the transportation process to be performed by the second car within a determined time interval, and move the second car into an avoidance stopping point outside the region between the start stopping point and the destination stopping point in response to the second car not leaving the region in the course of the transportation process to be performed by the second car within the determined time interval.

11. A computer program residing on a machine-readable storage medium that when executed by the elevator controller of claim 10 is configured to perform said command and determination steps.

12. A machine-readable storage medium that includes a computer program stored thereon, wherein the computer program is configured to perform the command and determination steps of the elevator controller of claim 10.

* * * * *